United States Patent [19]

Dehn

[11] Patent Number: 4,660,291

[45] Date of Patent: Apr. 28, 1987

[54] CHALK LINE APPARATUS

[76] Inventor: Frank A. Dehn, 16250 Saddle Club Rd., Fort Lauderdale, Fla. 33325

[21] Appl. No.: 868,676

[22] Filed: May 30, 1986

[51] Int. Cl.[4] ..... B44D 3/38

[52] U.S. Cl. ..... 33/414; 33/138; 33/613

[58] Field of Search ..... 33/414, 413, 138, 180 R, 33/137 R

[56] References Cited

U.S. PATENT DOCUMENTS

| | | | |
|---|---|---|---|
| 695,145 | 3/1902 | Cook | 33/413 |
| 997,831 | 7/1911 | Kiso | 33/414 |
| 2,398,805 | 4/1946 | Pomeroy | 33/414 |
| 3,475,822 | 11/1969 | DeLain | 33/87 |
| 3,721,009 | 3/1973 | Lucich | 33/414 |
| 4,143,462 | 3/1979 | Gertz | 33/414 |
| 4,149,320 | 4/1979 | Troyer et al. | 33/137 R |
| 4,152,836 | 5/1979 | Rodrique | 33/414 |
| 4,367,590 | 1/1983 | Winter et al. | 33/137 R |

*Primary Examiner*—Willis Little

*Attorney, Agent, or Firm*—Oltman and Flynn

[57] ABSTRACT

A chalk line apparatus comprising a holder for powdered chalk containing a rotatable reel, a flexible line wound on said reel, an exit opening for the line at one end of the holder, and an adjustable calibrated line-tensioning device in the holder between the reel and the exit opening for the line. The line has evenly spaced short segments of one diameter between the long segments of a different diameter. When the line is snapped, the chalk-covered short segments leave evenly spaced chalk marks which are visibly distinct from those left by the long segments of the line.

5 Claims, 11 Drawing Figures

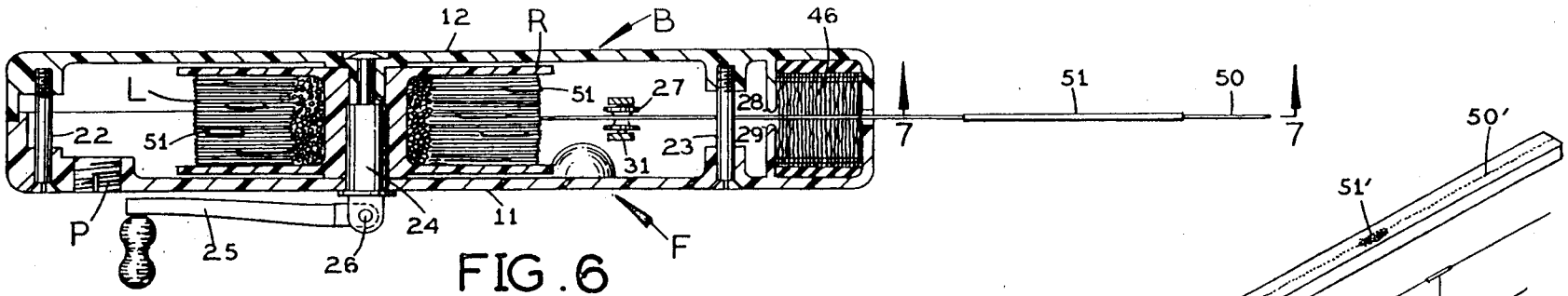
FIG. 6
FIG. 7
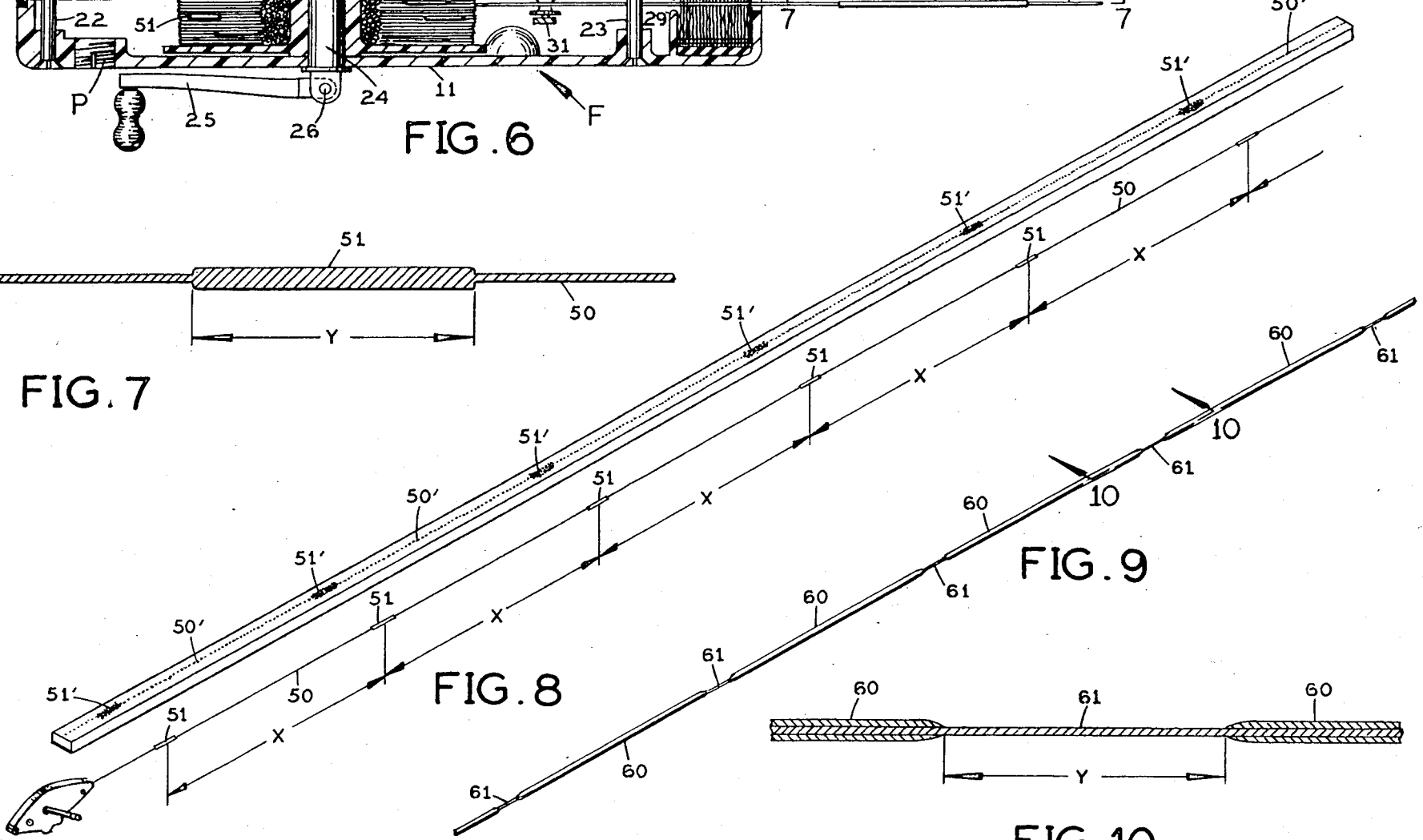
FIG. 9
FIG. 8
FIG. 10

CHALK LINE APPARATUS

SUMMARY OF THE INVENTION

This invention relates to a chalk line apparatus for depositing a line of chalk with visibly distinct markings at even intervals along its length.

The present invention is especially useful for making horizontal chalk lines along a bottom piece or top piece of a wall under construction to mark the locations of vertical studs that will be part of the finished wall.

In accordance with this invention, an elongated flexible line is stored in a holder which may be filled with powdered chalk and which has an exit opening through which the chalk covered line may be pulled out. The flexible line has short surface discontinuities at evenly spaced longer intervals along its length. These may be provided by short segments of the line which are larger or smaller in diameter than the rest of the line. After a suitable length of the chalk-covered line has been pulled out of the holder, while it is kept taut it is snapped against the surface on which a straight line of chalk is to be applied. The short segments of the line leave chalk markings that are readily distinguishable visually from the rest of the chalk line, and which show the desired locations for the vertical wall studs, for example.

Preferably, the present apparatus has a tensioning device for applying a suitable tension on the line so that the visibly distinct segments of the line of chalk will be at the correct even intervals. In the preferred embodiment this tensioning device is adjustable to compensate for stretching of the line.

A principal object of this invention is to provide a novel chalk line apparatus for depositing a straight line of chalk which has visibly distinct short segments at evenly spaced longer intervals.

Another object of this invention is to provide such an apparatus which is especially advantageous for use in locating the positions for vertical wall studs along bottom and top pieces of a building wall under construction.

Further objects and advantages of this invention will be apparent from the following detailed description of two presently preferred embodiments which are illustrated in the accompanying drawings.

DESCRIPTION OF THE DRAWINGS

FIG. 6 is a longitudinal section taken along the line 6—6 in FIG. 1;

FIG. 7 is an enlarged longitudinal section taken along the line 7—7 in FIG. 6 through part of the chalk line in the apparatus;

FIG. 8 is a perspective view showing the line pulled out of the holder and the manner in which it marks a chalk line on the horizontally elongated bottom piece of a building wall under construction;

FIG. 9 shows an alternative line for use in the present apparatus;

FIG. 10 is an enlarged longitudinal section taken along the line 10—10 in FIG. 9 through this alternative line.

Figure 1:
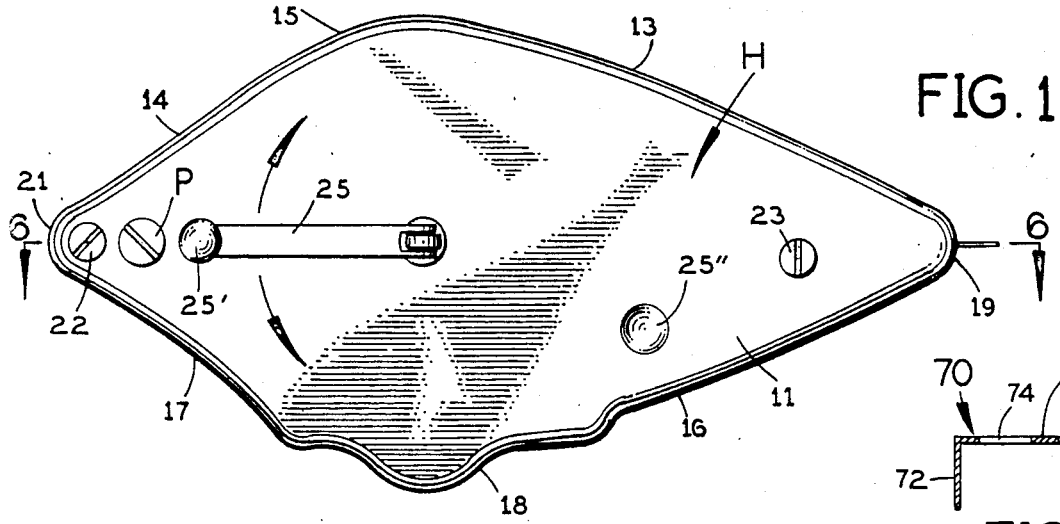
FIG. 1 is a front elevation of the present chalk line apparatus.

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

DETAILED DESCRIPTION

Referring to FIGS. 1–4, the present apparatus has a chalk line holder with a housing H that is relatively long from end-to-end and thin from front-to-back. The housing has a generally flat front wall 11 and a flat back wall 12 (FIGS. 2 and 3) which extends parallel to the front wall. As viewed in FIGS. 1 and 4, the housing has a top wall with a right segment 13 that is inclined downward to the right and a left segment 14 of shorter extent that is inclined downward to the left from a convex middle segment 15 joining it to the right segment 13. The bottom wall is aproximately a mirror image of the top wall, with a right segment 16 that inclines upward to the right, a shorter left segment 17 that inclines upward to the left, and a connecting middle segment 18 of irregular curvature. The right segments 13 and 16 of the top and bottom walls are joined to each other by a convex right end segment 19 which has a small opening 20 for passing the line L. The left segments 14 and 17 of the top and bottom walls of the housing are joined to each other by a convex left end segement 21.

As shown in FIG. 6, the housing H is of two-piece construction, having a front piece F which provides the front wall 11 and part of the top and bottom walls and curved opposite end segments 19 and 21, and a back piece B which provides the back wall 12 and the remainder of the top and bottom walls and the opposite end segments 19 and 21. Bolts 22 and 23 hold the opposite halves of the housing assembled together and engaging each other tightly enough to hold powdered chalk inside the housing without leaking.

A screw-threaded plug P (FIGS. 1 and 6) is screw-threadedly mounted in an opening in the front wall of the housing. This plug may be removed for inserting powdered chalk into the housing. Alternatively, the left end of the housing in FIG. 1 may be a separately formed piece with a snap-in fit on the rest of the housing so that it can be removed for filling the interior of the housing with powdered chalk.

Figure 4:
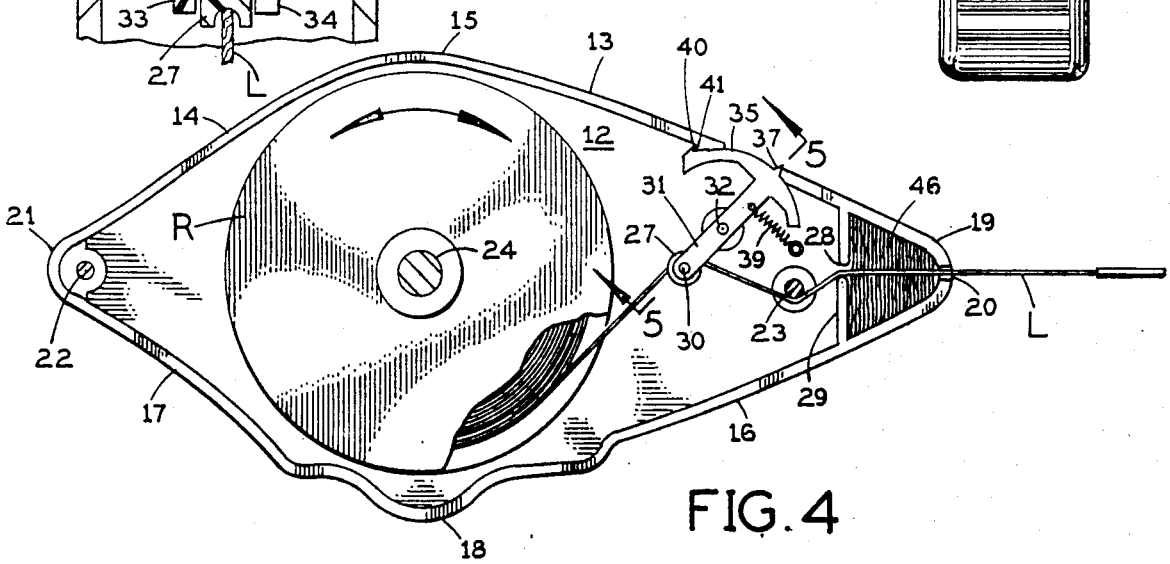
FIG. 4 is a longitudinal section taken along the line 4—4 in FIG. 2.

Inside the housing at its widest part from top to bottom (i.e., between the curved segments 15 and 18 of the top and bottom walls) a line-supporting reel R is mounted on a cross-shaft 24, which is rotatably mounted in the housing, as shown in FIGS. 4 and 6. A crank 25 for rotating the reel is pivotally coupled at 26 to the cross shaft 24. The line L, which typically is 50 or 100 feet long, is drawn into the housing when the crank 25 is turned in one direction, and it can be withdrawn from the housing by pulling on the line (which causes the reel to turn in that opposite direction).

Figure 2:
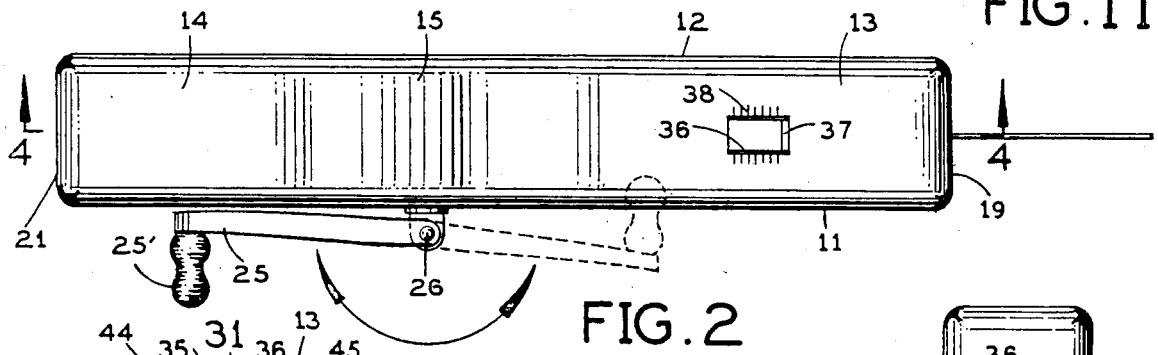
FIG. 2 is a top plan view.

The crank 25 may be pivoted from the operative full-line position of FIG. 2 to the phantom line position in that Figure in which its handle 25' seats in convex recess 25'' (FIG. 1) in the front wall 11 of the housing to lock the reel R against rotation.

Figure 5:
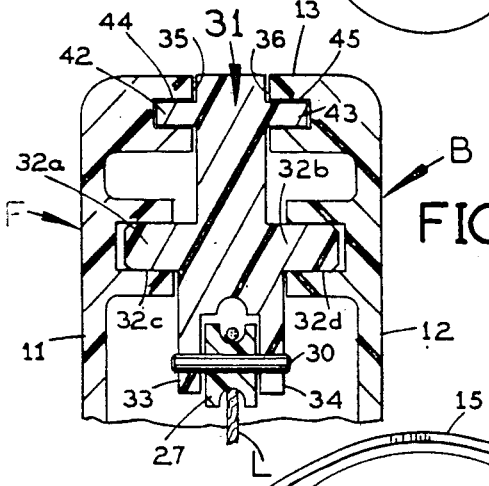
FIG. 5 is a fragmentary cross-section taken along the line 5—5 in FIG. 4 at the line tensioning mechanism in the holder.
Figure 3:
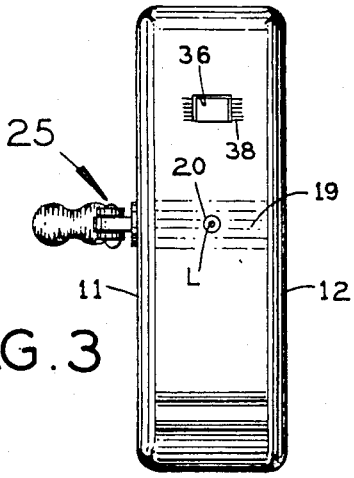
FIG. 3 is an end elevation taken from the left end of FIGS. 1 and 2.

As shown in FIG. 4, the line L extends from the bottom of the reel R upward and to the right, passing over the top of a grooved guide roller 27 (FIGS. 4 and 6) and then passing beneath the bolt 23 and through an opening 28 in an internal wall 29 of the housing located a short distance from the end opening 20 in the housing. As shown in FIG. 4, roller 27 is rotatably mounted at 30 on the lower end of a line-tension lever 31, which is pivotally mounted on the housing at 32. Referring to FIG. 5, roller 27 is rotatable on a cross pin 30 anchored in opposite segments 33 and 34 of the lever 31 at its lower end. The pivotal support 32 for lever 31 is provided by cylindrical stub shafts **32*a* and 32*b* which project from opposite sides of the lever into complementary recesses 32*c* and 32*d*** on the inside of the housing.

The line-tension lever 31 at its upper end has an elongated arcuate segment 35 which is slidably received in an opening 36 (FIGS. 2, 3 and 6) in the right segment 13 of the top wall of the housing. This arcuate segment of the lever has an upwardly projecting pointer 37 (FIG. 4) which registers with calibration lines 38 (FIG. 2) on either side of the housing opening 36, depending upon the angular position at which lever 31 is set. A coil spring 39 (FIG. 4) is under tension between lever 31 and the housing. This spring biases lever 31 clockwise in FIG. 4 to the position shown there in which the pointer 37 engages the front end of the housing opening 36. The arcuate segment 35 of the pointer also presents a protrusion 40 near its left end which abuts against an internal shoulder 41 on the inside of the top wall segment 13 in this position of the arcuate segment.

As shown in FIG. 5, the lever 31 has laterally extending arms 42 and 43 on opposite sides of its arcuate segment 35. These arms are slidably received in arcuate recesses 44 and 45 on the inside of the housing.

In the extreme clockwise position of lever 31, shown in FIG. 4, the top of the line guide roller 27 (where the line passes over it) is in its uppermost position above the level of the bottom of bolt 23 (where the line passes under it). The lever 31 assumes this position when there is no tension on the line L.

The angular position of lever 31 is determined by the tension on line L. The greater the line tension, the farther lever 31 will be displaced counterclockwise from the no-tension position shown in FIG. 4. The position of pointer 37 along the calibrated scale 38 gives a visual reading of the line tension.

Throughout the range of positions of pointer 37 along the calibrated scale, lever 31 positions the line guide roller 27 so that it deflects the line L from a straight path between reel R and the line exit opening 20. (The bolt 23 also deflects the line from such a straight path.) The bias force which spring 39 exerts on lever 31 produces an upward line-deflecting force on guide roller 27 so lever 31 opposes the withdrawal of the line from the holder in all pivotal positions of lever 31.

Between the line-exit opening 20 in its right end and the internal wall 29 the interior of the housing receives brushes or a sponge, shown schematically at 46 in FIG. 4, for removing excess chalk from the line L before it reaches the exit opening 20.

In accordance with the present invention, the flexible line L is formed with surface discontinuities at predetermined even intervals along its length.

In the embodiment shown in FIGS. 7 and 8, the line has relatively long, discrete segments 50 of small diameter which are interconnected in succession by much shorter segments 51 of substantially larger diameter. For example, each segment 50 may be 3/32 inch in diameter and each segment 51 may be 5/32 inch in diameter. The length of these shorter segments (shown at Y in FIG. 7) compared to the long segments (50) is exaggerated in FIG. 8. In actual practice, the short segments 51 may be $1\frac{1}{2}$ inches long and the long segments 50 may be $14\frac{1}{2}$ or $22\frac{1}{2}$ inches long to provide distinctive marking intervals (shown at X in FIG. 8) of 16 or 24 inches along the line. As shown in dotted lines in FIG. 8, when this chalk line is snapped against the surface to be marked, the markings 51' made by the thicker short segments 51 of the line are visibly distinguishable from the markings 50' made by the thinner long segments 50 of the line. These short segments 51' of the chalk mark, 16 or 24 inches apart center-to-center, may provide the locations of studs for a building wall under construction, for example.

FIGS. 9 and 10 show a second embodiment of the line in accordance with this invention. In this embodiment the short segments 61 are substantially smaller in diameter than the long segments 60. When this line is snapped against a surface to be marked the long segments 60 leave a wider chalk impression than the short segments 61. The narrower chalk marks may be used to locate wall studs, for example.

Figure 11:
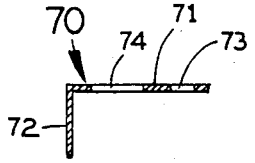
FIG. 11 is a longitudinal sectional view of an end piece for attachment to the leading end of the flexible line in this apparatus.

As shown in FIG. 11, a metal end piece 70 for attachment to the leading end of the flexible line in the present apparatus is generally L-shaped, with a thin flat major segment 71 and a shorter end lip 72 extending perpendicular to the major segment at one end. Near its opposite end the major segment has an opening 73 in which the free end of the line may be inserted and knotted. Another opening 74 in the major segment of the end piece is large enough to pass a nail for attaching this end of the line while the user pulls on the holder at the opposite end to provide the desired tension on the line before it is snapped against the surface on which the line of chalk is to be deposited.

In the use of this apparatus, the leading end of the flexible line is held at the desired location for that end of the line of chalk that is to be deposited. The holder is held beyond the desired location for the opposite end of this line of chalk. With the crank handle 25' seated in the holder recess 25'', the user pulls on this end of the line enough to establish the desired tension reading along scale 38, so that the actual interval between successive short segments 51 or 61 in the line correspond to the desired spacing between the visibly distinctive chalk markings they will make regardless of how much the thus-tensioned line may be stretched.

The user now snaps the line against the surface on which it is used, leaving a straight line of chalk on that surface which has the properly spaced, visibly distinctive short segments.

I claim:

1. A chalk line apparatus comprising:

a holder providing a compartment for holding powdered chalk and having a small line exit opening at one end;

a reel rotatably mounted in said holder;

a flexible line wound on said reel and extending from said reel through said line exit opening to the outside of the holder, said line having surface discontinuities at predetermined intervals along its length which produce visible discontinuities in the chalk marking produced by said line outside the holder;

a line guide in said holder compartment engaging said flexible line between said reel and said line exit opening;

a support for said line guide movably mounted in said holder and positioning said line guide within a range of positions throughout which the line guide deflects the line from a straight path between said reel and said line exit opening;

and spring means acting between said holder and said support to bias the support to oppose the withdrawal of the line from the holder by positioning said line guide to deflect the line from a straight path between said reel and said line exit opening.

2. A chalk line apparatus according to claim 1 and further comprising:

calibrated means for providing a visual indication of the position of said line guide support to show the tension on said line outside the holder.

3. A chalk line apparatus comprising:

a holder providing a compartment for holding powdered chalk and having a small line exit opening at one end;

a reel rotatably mounted in said holder;

a flexible line wound on said reel and extending from said reel through said line exit opening to the outside of the holder, said line having surface discontinuities at predetermined internals along its length which produce visible discontinuities in the chalk marking produced by said line outside the holder;

a line guide roller in said holder compartment engaging said flexible line between said reel and said line exit opening;

a lever pivoted between its ends on said holder and carrying said line guide roller on one end, said lever being movable pivotally to position said line guide roller within a range of positions throughout which the roller deflects the roller from a straight path between said reel and said line exit opening, said lever having a pointer on its opposite end;

said holder having an additional opening which passes said pointer without interfering with the pivotal movement of the lever, said holder having a calibrated scale alongside said additional opening to indicate the position of the pointer;

and a spring in said holder biasing said lever to oppose the withdrawal of the line from the holder by positioning said line guide roller to deflect the line from a straight path between said reel and said line exit opening.

4. A chalk line apparatus according to claim 3 wherein:

said flexible line has discrete long segments and short segments located between and connecting successive long segments, said short segments being substantially thinner than said long segments to provide said surface discontinuities in the line.

5. A chalk line apparatus according to claim 3 wherein:

said flexible line has discrete long segments and short segments located between and connecting successive long segments, said short segments being substantially thicker than said long segments to provide said surface discontinuities in the line.

* * * * *